US008051792B2

(12) United States Patent
Mochizuki

(10) Patent No.: US 8,051,792 B2
(45) Date of Patent: Nov. 8, 2011

(54) BOAT BODY AND BOAT INCLUDING THE SAME

(75) Inventor: Yasushi Mochizuki, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 127 days.

(21) Appl. No.: 12/395,797

(22) Filed: Mar. 2, 2009

(65) Prior Publication Data

US 2009/0224132 A1 Sep. 10, 2009

(30) Foreign Application Priority Data

Mar. 5, 2008 (JP) ..... 2008-054319

(51) Int. Cl.
*B63B 1/00* (2006.01)

(52) U.S. Cl. ..... 114/271

(58) Field of Classification Search ..... 114/271, 114/288, 289, 290, 291, 56.1, 61.2, 343, 114/150, 151, 57; 440/49, 53, 55, 66, 67, 440/68, 76, 111
See application file for complete search history.

(56) References Cited

U.S. PATENT DOCUMENTS 3,107,074 A * 10/1963 Fowler ..... 248/641
3,749,046 A * 7/1973 Ow ..... 440/49
4,895,095 A * 1/1990 Potter, Jr. ..... 114/343
5,322,030 A * 6/1994 Brehmer ..... 114/343
7,565,876 B2 * 7/2009 Wilson et al. ..... 114/122
7,789,032 B1 * 9/2010 McDugle et al. ..... 114/151

FOREIGN PATENT DOCUMENTS

JP 2005-212705 A 8/2005

OTHER PUBLICATIONS

Mochizuki; "Boat"; U.S. Appl. No. 12/395,801, filed Mar. 2, 2009.

* cited by examiner

*Primary Examiner* — Daniel Venne
(74) *Attorney, Agent, or Firm* — Keating & Bennett, LLP

(57) ABSTRACT

A boat body for a boat includes a projecting portion arranged to support one or more outboard motors at a position spaced upward and rearward from a transom. The projecting portion extends from a rear portion of the transom of the boat body, and the projecting portion supports the outboard motors at locations upward and further rearward than in a case where the outboard motors are directly installed on the transom. The projecting portion includes a projecting member that is bilaterally symmetrical and that decreases in width in a rearward direction and in an upward direction. The projecting portion includes a side thruster passing through the projecting portion in a horizontal direction. When viewed from the side, a lower edge portion of the projecting portion includes a slanting portion that is generally linear and that extends rearward and upward from a lower portion of the transom. When viewed from the rear, the lower edge portion of the projecting portion has a generally V-shape.

17 Claims, 10 Drawing Sheets

BOAT BODY AND BOAT INCLUDING THE SAME

BACKGROUND OF THE INVENTION

1. Field of the Invention

The present invention relates to a boat body for a boat including a projecting portion arranged to support an outboard motor, and a boat constructed by installing an outboard motor on the projecting portion.

2. Description of the Related Art

Conventionally, a known boat is constructed such that an outboard motor is installed on a transom board formed in a rear portion of a boat body so that the boat runs by a driving force provided by the outboard motor (see, for example, JP-A2005-212705). In this boat, two outboard motors are installed on the transom board in the rear portion of the boat body, and a well board is disposed close to the transom board such that the outboard motors come into contact with the well board when the outboard motors are tilted up. The well board includes a lower portion fixed to the boat body and an upper portion that is tiltably connected to the lower portion such that the upper portion is tilted into a position in which the outboard motors do not come into contact with the upper portion when the outboard motors are tilted up. This structure allows for an increase in the deck space usable by the crew of the boat.

However, in the conventional boat described above, the installation of an outboard motor directly on the transom board that is arranged vertically in the rear portion of the boat body causes a reduction in the distance between the transom board and the outboard motor. As a result, it is necessary to install the outboard motor at a lower position to prevent a propeller of the outboard motor from drawing air. More specifically, when the boat is running, water flow occurs such that water flows from a cutwater surface in the lower end portion of the transom board in a rearward direction along an upwardly curved path. If the distance between the transom board and the outboard motor is small, a large difference does not occur in the height of the water flow between the transom board and the outboard motor.

This causes the propeller of the outboard motor to easily draw air. To avoid this problem, it is necessary to install the outboard motor at a lower position. However, this causes a major portion of the outboard motor to be submerged, which results in an increase in water resistance and in turn results in a reduction in propulsion efficiency. It is desirable to install an electronic unit above the outboard motor such that the location of the electronic unit is as far as possible from the water surface to protect the electronic unit from water. However, in the conventional boat described above, it is difficult to install the electronic unit in such a manner.

SUMMARY OF THE INVENTION

In order to overcome the problems described above, preferred embodiments of the present invention provide a boat body including a projecting portion arranged to support an outboard motor at a position spaced upward and rearward from a transom, and also a boat including such a boat body having a projecting portion.

According to a preferred embodiment of the present invention, a boat body includes a projecting portion provided on a rear portion of a transom arranged to support an outboard motor, in which the projecting portion is constructed to support the outboard motor at a location upward and further rearward than in a case where the outboard motor is directly installed on the transom.

In the boat body constructed in this manner, the projecting portion is provided on the rear portion of the transom, and the outboard motor is installed on the projecting portion. Thus, in the boat body, the outboard motor can be installed at a location upward and further rearward than in the structure of a boat body in which the outboard motor is directly installed on the transom. That is, by arranging the outboard motor at the location spaced rearward from the transom by a distance corresponding to the fore-and-aft length of the projecting portion, it becomes possible to ensure that the lower portion of the outboard motor catches the water flow coming upward along a curved path from the lower end portion of the transom when the boat with the outboard motor installed in the above-described manner is running. This makes it possible to arrange the outboard motor at a higher position.

By installing the outboard motor in the above-described manner, it becomes possible for the boat to run in a stable manner. In particular, when the boat with the outboard motor installed on the boat body in the above-described manner makes a turn at a high speed, the lower portion of the outboard motor is stably surrounded by the water flow deflected by the transom, and thus the turn is made in a stable manner without drawing air which often occurs with conventional boats. Furthermore, arranging the outboard motor at a higher position causes less of the outboard motor to be submerged, which results in a decrease in water resistance and in turn results in an increase in propulsion efficiency. Furthermore, it becomes possible to locate the electronic unit above the outboard motor such that the location of the electronic unit is sufficiently far from the water surface thereby ensuring that the electronic unit is protected from water. In the boat body according to a preferred embodiment of the present invention, it is desirable that the lower end portion of the projecting portion be at a higher location than the lower end portion of the transom, and a step be provided between the transom and the projecting portion.

In the boat body according to another preferred embodiment of the present invention, the projecting portion includes a projecting member that is bilaterally symmetrical (i.e., having left and right symmetrical portions) and that decreases in width in a horizontal direction in a rearward and a downward direction. Disposing the outboard motor on the boat body results in an increase in the weight in the stern portion of the boat body. As a result, the stern portion of the boat body tends to be submerged deeper than the bow portion. However, the presence of the projecting portion in the water produces buoyancy which prevents the boat body from being inclined greatly. It is also desirable that the left-side and right-side surfaces of the projecting portion be constructed to have convex surfaces.

In the boat body according to another preferred embodiment of the present invention, the projecting portion includes a side thruster passing through the projecting portion in a horizontal direction. In this structure, a side thruster that is disposed in the bow portion of the boat body is also disposed in the stern. This makes it possible to adjust the position at both the bow and the stern, and thus the operation in bringing the boat alongside a pier or the like becomes easier.

In the boat body according to another preferred embodiment of the present invention, the lower edge portion of the projecting portion includes, as viewed from the side, a slanting portion that is generally linear and that extends rearward and upward from the lower portion of the transom. In this structure of the boat body with the outboard motor installed on the projecting portion, it becomes possible to prevent the projecting portion from creating resistance in the water when the boat runs.

In the boat body according to another preferred embodiment of the present invention, the lower edge portion of the projecting portion preferably has a generally V-shape as viewed from the rear. In this structure, the boat body has a so-called double ender shape, which provides an improvement in the running performance when the boat body with the outboard motor installed on the projecting portion is driven backwards.

According to a preferred embodiment of the present invention, there is provided a boat constructed by installing an outboard motor on a projecting portion of the boat body, in which when the boat is at rest on water, the projecting portion is submerged in the water thereby generating buoyancy at a rear portion of the boat, and when the boat is running faster than a specified speed and planing on the water surface, the projecting portion rises above the water surface. This structure makes it possible to provide a boat that is not inclined greatly when the boat is at rest, and that can run without creating a large resistance, which provides comfortable running conditions. In a preferred embodiment of the present invention, the specified speed is preferably a speed at which the running mode of the boat is switched from low-speed running to a planing mode.

According to a preferred embodiment of the present invention, there is provided a boat constructed such that the projecting portion includes a lower edge portion located higher than a lower edge portion of the transom, and a cavitation plate is disposed above and adjacent to a propeller connected to the outboard motor, and the outboard motor is installed on the projecting portion such that the cavitation plate is at generally the same height as the lower edge portion of the projecting portion as viewed from the rear of the boat. In this structure, unlike in the conventional boat in which the cavitation plate is located at the lower end of the transom board, the cavitation plate is at a location higher than the lower end portion of the transom board. Nevertheless, the cavitation plate is capable of applying resistance to the water in a highly reliable manner thereby preventing the propeller from drawing air.

According to another preferred embodiment of the present invention, there is provided a boat in which a plurality of outboard motors are installed on the projecting portion such that the outboard motors are located side by side in a horizontal direction. This structure makes it possible to provide a boat capable of outputting a driving force required to drive the boat even when the size of the boat is increased.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
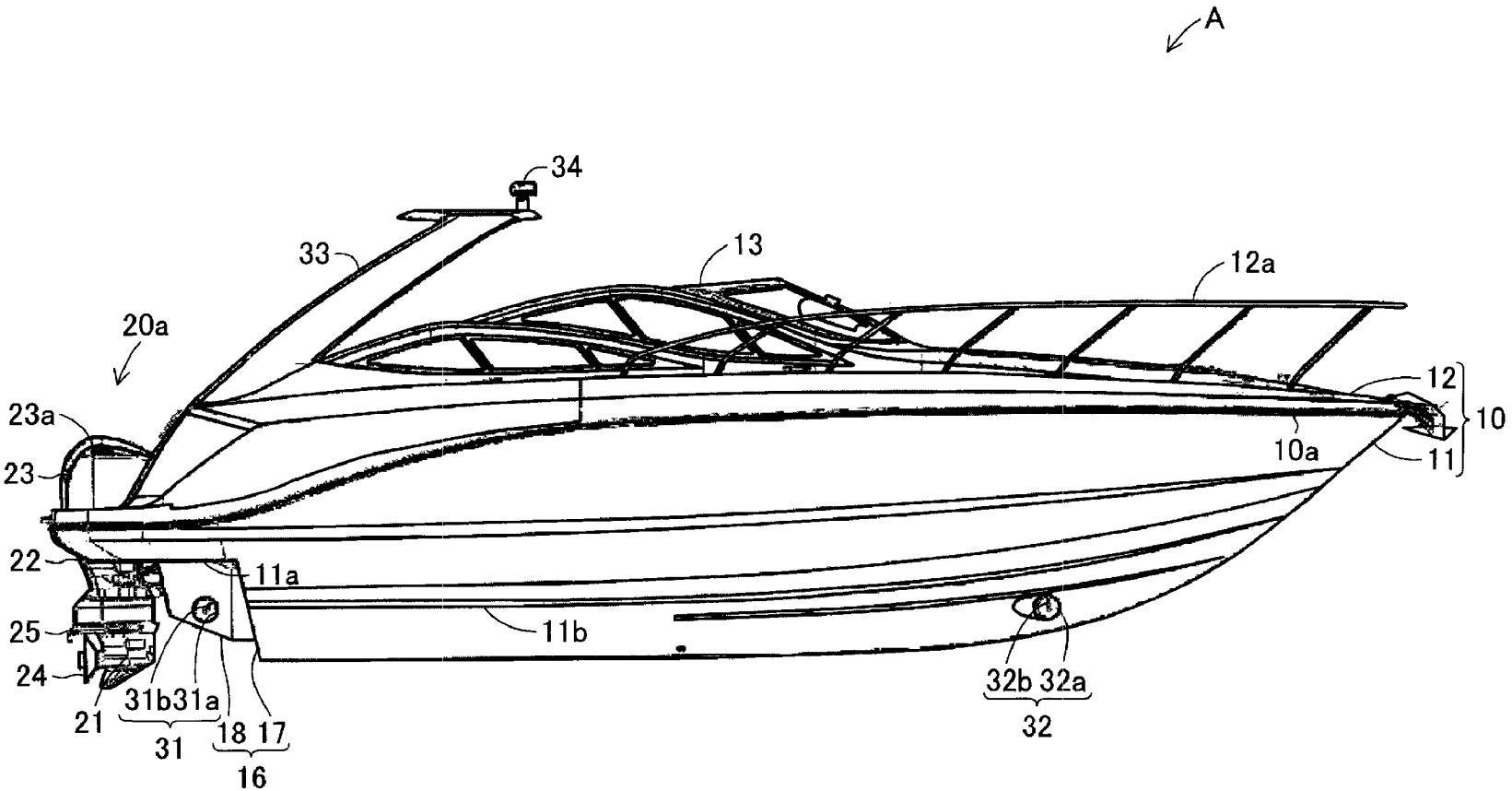
FIG. 1 is a side view of a boat according to a preferred embodiment of the present invention.
Figure 2:
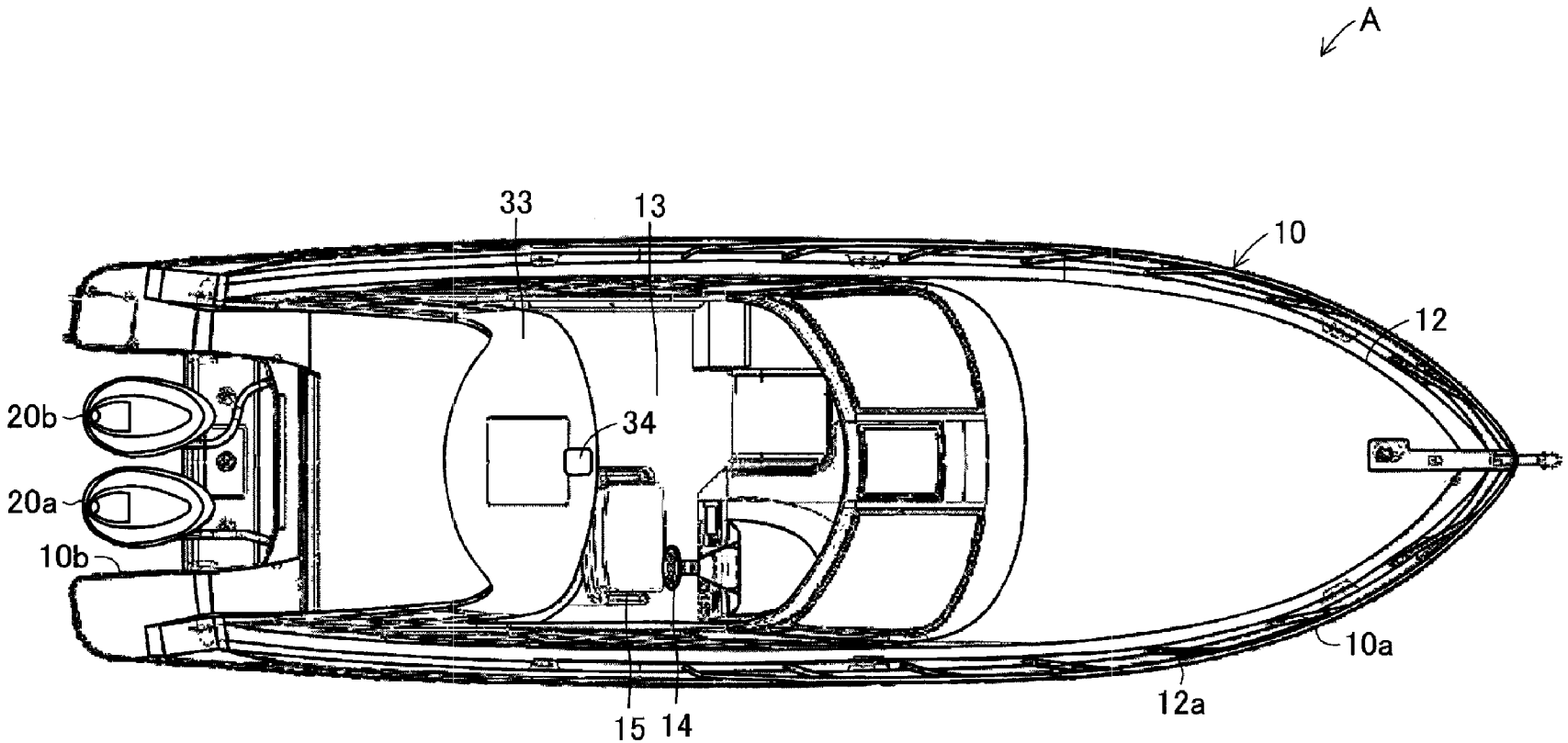
FIG. 2 is a plan view of the boat.

Preferred embodiments of the present invention will be described below with reference to the drawings. FIGS. 1 to 4 illustrate a boat (A) according to a preferred embodiment. In this boat (A), a boat body 10 includes a hull 11 defining a bottom portion of the boat body, and a deck 12 defining a top board. Peripheral portions of the hull 11 and the deck 12 are water-tightly connected to each other so as to form a gunwale portion 10*a* at a periphery of the boat body 10. A cockpit 13 is provided in an upper portion of the boat body 10 in an area from the generally middle to the rear end as viewed in a fore-and-aft direction. On the starboard side in the cockpit 13, a steering wheel 14 and an operator's seat 15 are provided in tandem. In the vicinity of the steering wheel 14, there are provided various kinds of devices, such as a start switch, a meter, an operating lever for an acceleration/deceleration operation, etc., necessary in steering the boat (A).

The front-side portion of the upper surface of the deck 12 and the peripheral area around the cockpit 13 include a passageway with a specified width so that the crew can walk thereon. In the center of the rear-end portion of the boat body 10, there is a recess 10*b* which is substantially rectangular in plan view and open at its rear end. The recess 10*b* is completely hollow in the vertical direction. A recess 11*a*, which is open at its rear end and at its bottom and which is generally rectangular in a side view, is provided in a lower portion of a rear-end portion of the hull 11. A transom bottom 16 with a double ender shape is provided in a front-side portion in the recess 11*a* in the hull 11.

Figure 3:
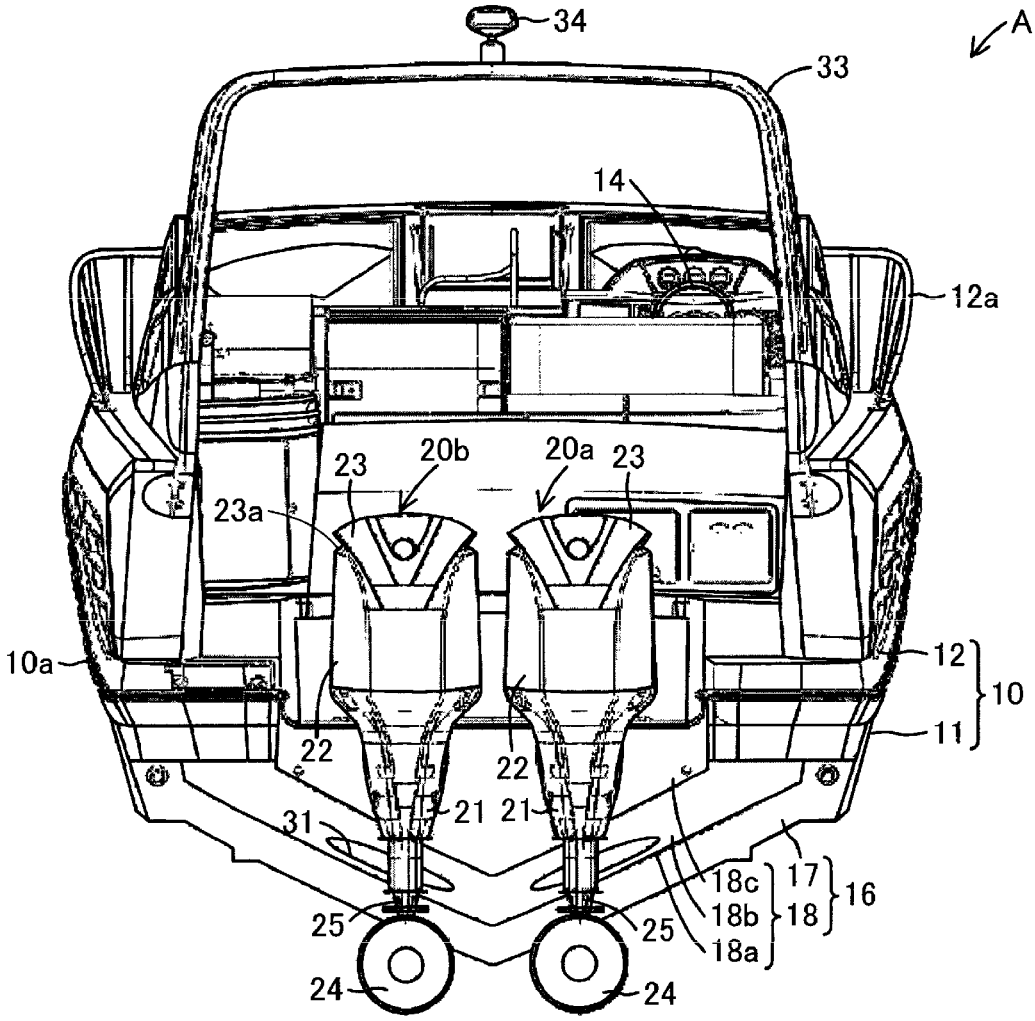
FIG. 3 is a rear view of the boat.
Figure 4:
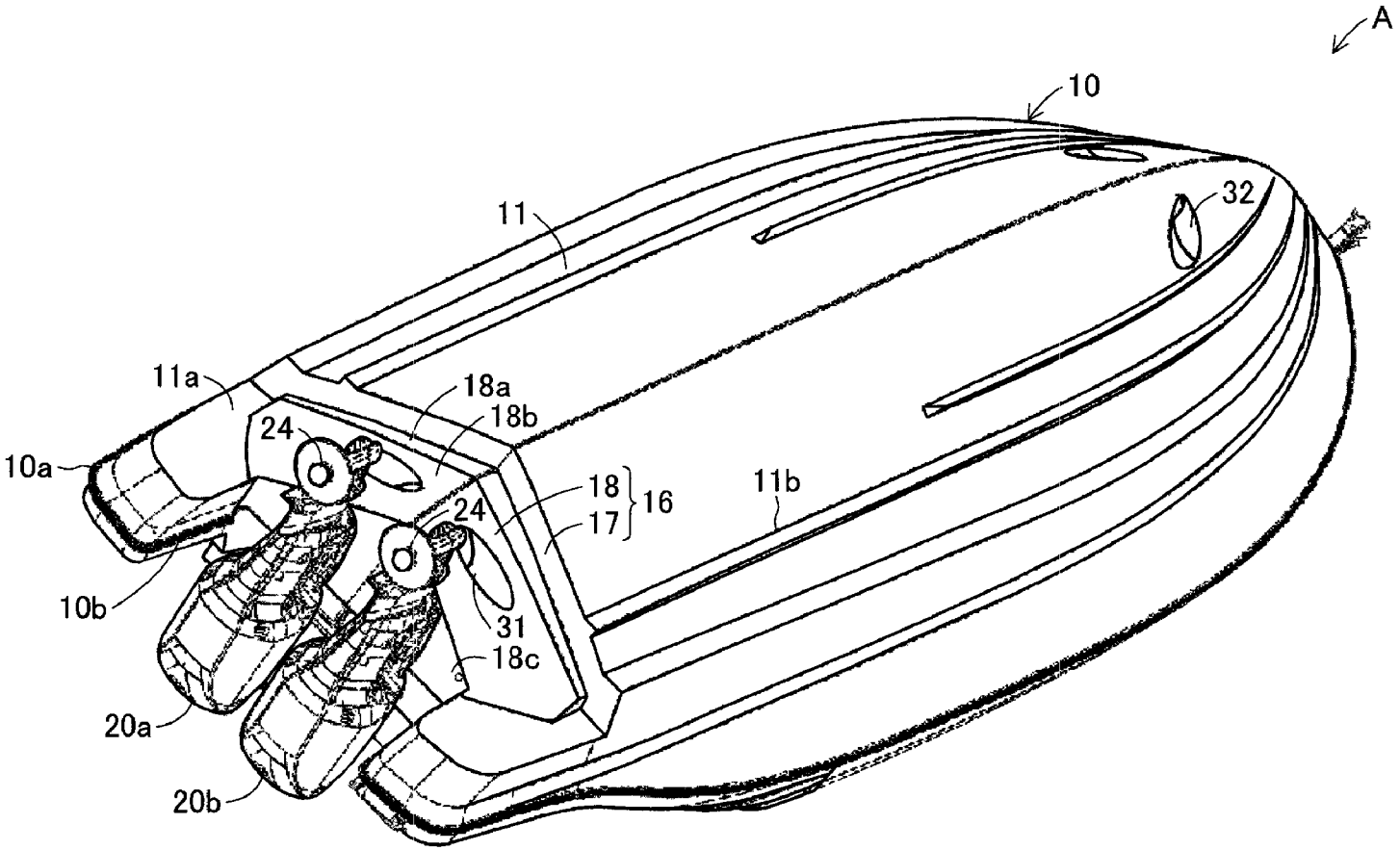
FIG. 4 is a perspective view illustrating a bottom portion of the boat.

The transom bottom 16 includes transom 17 and a projecting portion 18. The transom 17 has an approximately vertical surface whose upper portion is located at a slightly rearward-tilted position with respect to its lower portion. The projecting portion 18 projects rearward from the transom 17 except for the left and right side portions and the bottom portion of the transom 17. That is, the transom 17 defines the surface of a vertical wall in the front of the recess 11*a*. More specifically, as shown in FIG. 3, the transom 17 defines a surface with a bilaterally symmetrical V-shape having a generally constant width extending along the V-shaped lower edge of the hull 11. When the projecting portion 18 is viewed from the rear, its lower edge has a generally V-shape along the upper edge of the transom 17 and the upper edge has a linear shape extending horizontally in a left and right direction and thus the projection portion 18 has a generally bilaterally symmetrical triangular shape when viewed from the rear.

Figure 5:
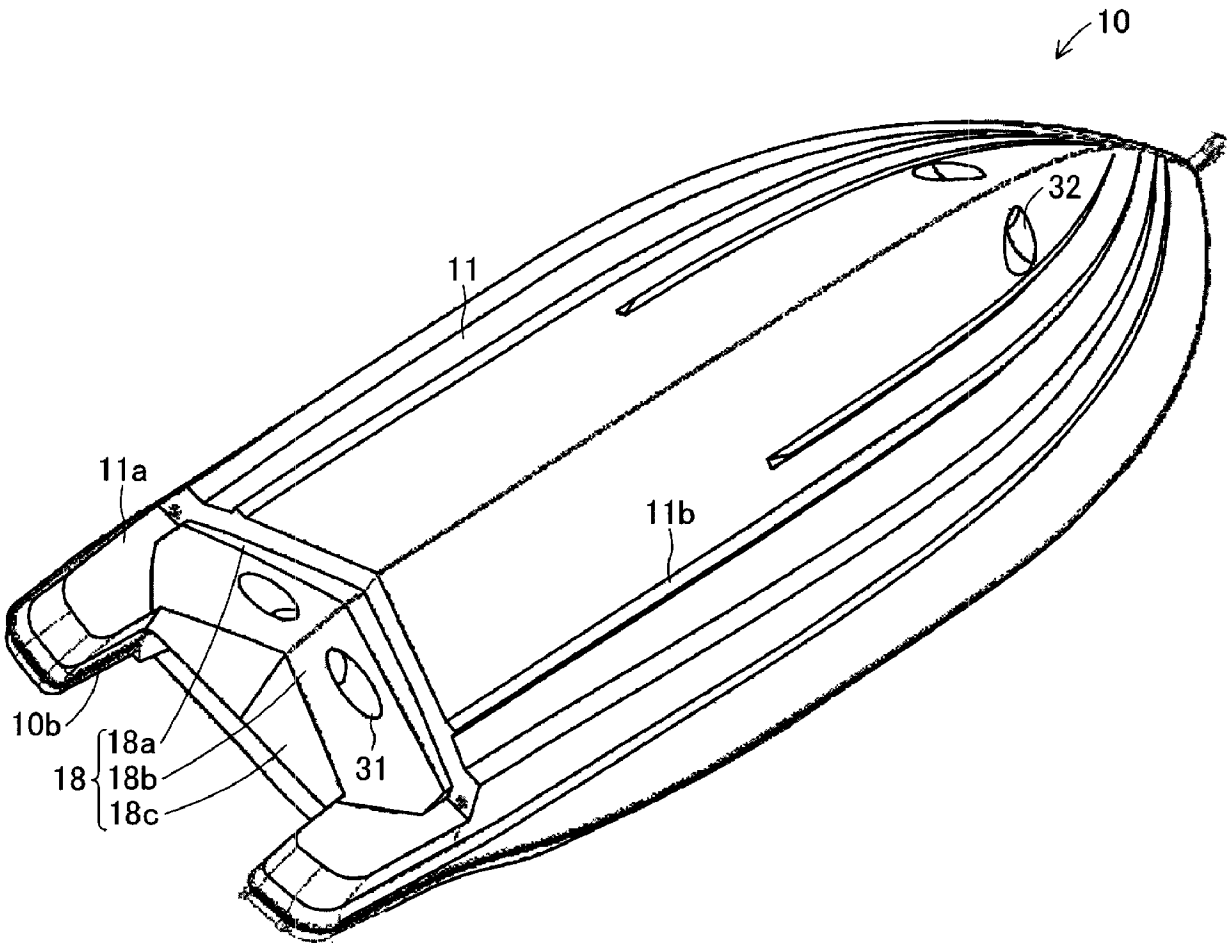
FIG. 5 is a perspective view illustrating the boat in a state in which the outboard motors are removed.

When the shape of the projecting portion 18 is viewed from a side, its lower edge portion includes a short portion extending in a horizontal and rearward direction from a portion slightly upward from the lower end of the transom 17, a slanting portion extending rearwardly and upwardly from the rear end of the short portion, and a portion extending rearwardly at an almost vertical angle from the rear end of the slanting portion. The upper edge portion of the profile of the projecting portion 18 includes a horizontal portion along the recess 11*a* and a slanting portion. That is, as shown in FIG. 5, the projecting portion 18 includes the short portion 18*a* in the fore-and-aft direction that extends parallel or substantially parallel to the hull 11, the slanting portion 18*b*located at the rear of the short portion 18*a* and having a width decreasing as the slanting portion 18*b* extends in a rearward direction and a downward direction, and the rear surface portion 18*c* including the approximately vertical slanting surface.

As described above, the projecting portion 18 has a bilaterally symmetrical convex surface, and the recess 10*b* is located in the rear of the rear-surface portion 18*c* of the projecting portion 18. A pair of outboard motors 20*a* and 20*b* is installed on the upper edge portion of the rear-surface portion 18*c* of the projecting portion 18. The outboard motors 20*a* and 20*b* preferably have the same structure. The outboard motors 20*a* and 20*b* are installed on the rear-surface portion 18*c* via an installation member 20*c* (see, FIG. 6) such as swivel brackets or clamp brackets such that the outboard motors 20*a* and 20*b* can be pivoted by an operation of a tilt and trim apparatus (not shown) in vertical directions about a pivot shaft provided on the installation member 20*c*.

Although the internal structure is not shown in the figures, each of the outboard motors 20*a* and 20*b* includes a lower case 21 in which a propulsion unit is disposed, an upper case 22 which is disposed above the lower case 21 and connected thereto and in which a drive shaft is disposed, and a cowling 23 which is disposed above the upper case 22 and connected thereto and in which an engine is disposed. In the inside of the cowling 23, an electronic unit arranged to control the operation of the outboard motors 20*a* and 20*b* is also provided. The propulsion unit includes a propeller 24 connected to the rear end of a propeller shaft disposed in a generally horizontal position. The lower end of a crankshaft connected to the engine is connected to the upper end of the drive shaft. Thus, when the engine operates, the driving force generated thereby is transmitted to the propeller 24 via the crankshaft, the drive shaft, the propeller shaft, thereby rotating the propeller 24 and thus generating thrust.

Figure 6:
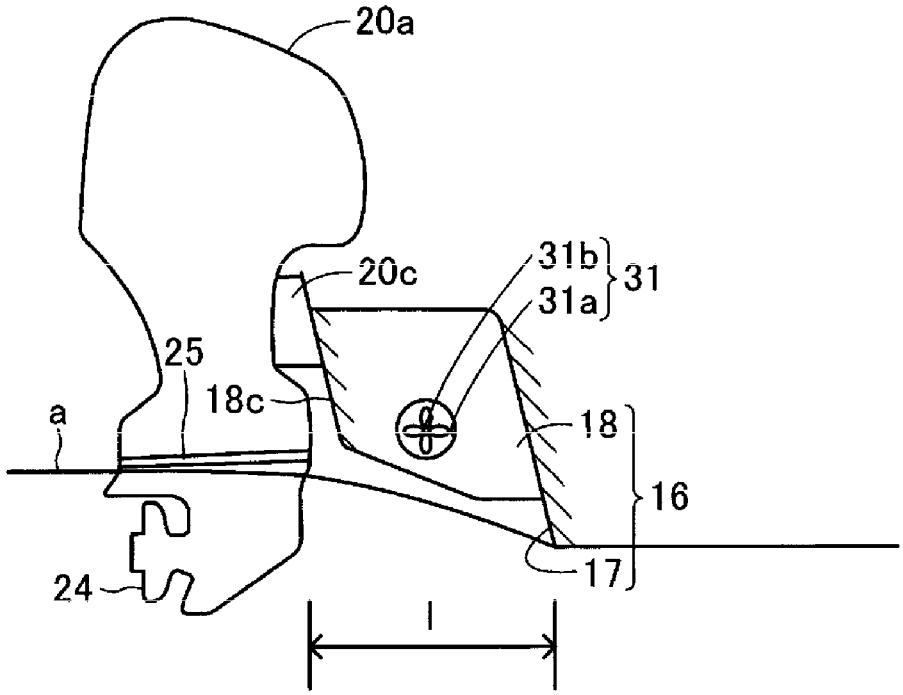
FIG. 6 is a side view illustrating a positional relationship between a transom and the outboard motors.
Figure 7:
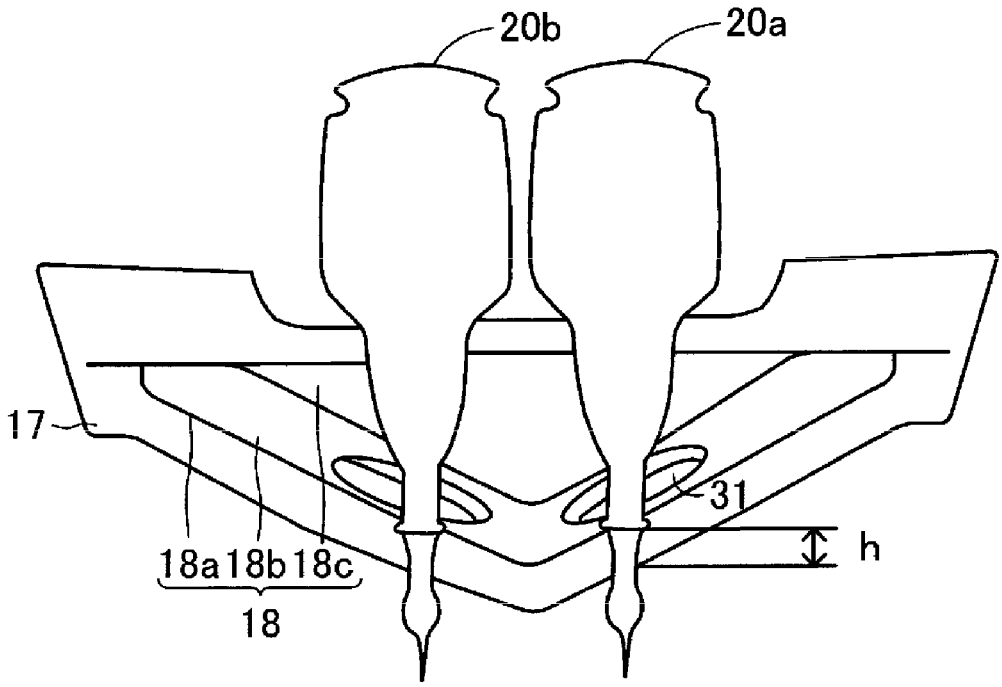
FIG. 7 is a rear view illustrating a positional relationship between a transom and the outboard motors.

On the periphery of the upper portion of the lower case 21, there is provided a cavitation plate 25 to prevent the propeller 24 from drawing air. By providing the cavitation plate 25, it is possible to reduce the depth in the water of the outboard motors 20*a* and 20*b*. Furthermore, the cavitation plate 25 provides an improvement in drivability of the boat (A). The location in the vertical direction of the cavitation plate 25 is generally the same in a side view as the lower end of the rear-surface portion 18*c* of the projecting portion 18 as shown in FIG. 6, and is generally the same in a rear view as the parallel portion 18*a* as shown in FIG. 7.

Figure 8:
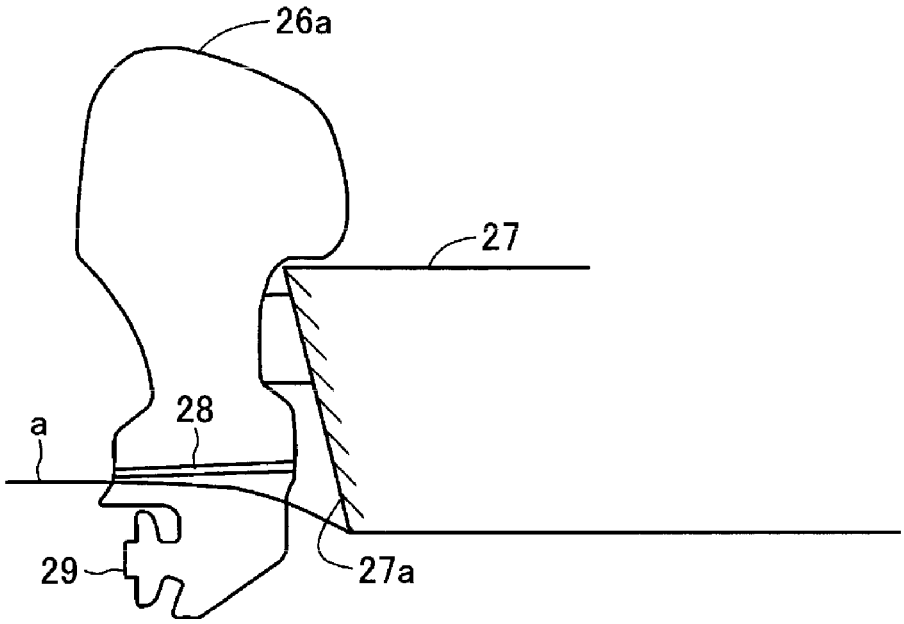
FIG. 8 PRIOR ART
FIG. 8 is a side view illustrating a positional relationship between a transom and the outboard motors in a conventional boat.
Figure 9:
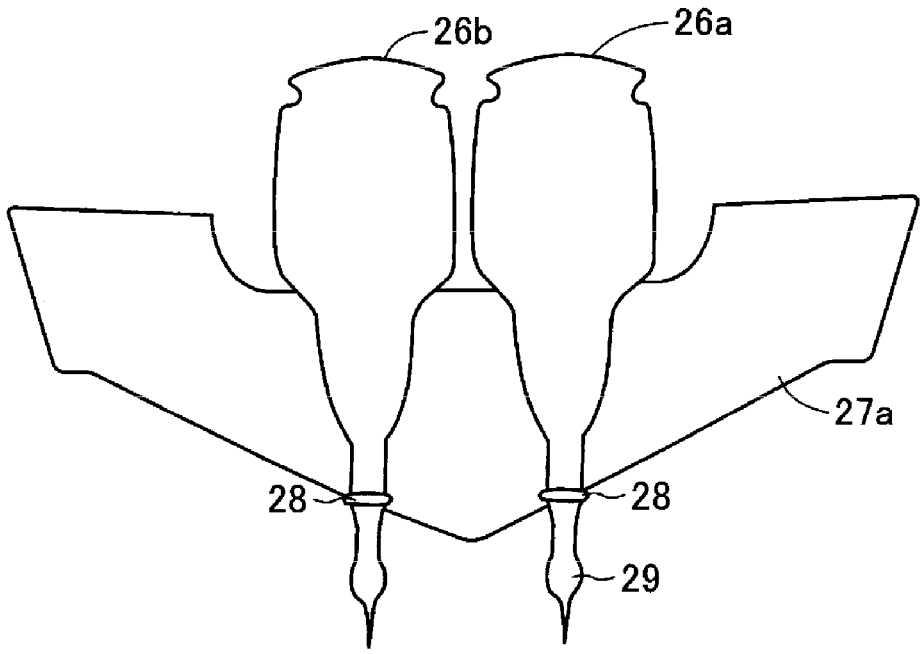
FIG. 9 PRIOR ART
FIG. 9 is a rear view illustrating a positional relationship between a transom and the outboard motors in a conventional boat.

In the present preferred embodiment, the outboard motors 20*a* and 20*b* are installed on the boat (A) such that the outboard motors 20*a* and 20*b* are at higher and further rearward locations with respect to the transom 17 compared with the locations of the outboard motors 26*a* and 26*b* on a conventional boat (see FIG. 8 and FIG. 9). In the conventional boat, the outboard motors 26*a* and 26*b* are directly installed on the transom 27*a* that forms the rear-end portion of the boat body 27, and thus the outboard motors 26*a* and 26*b* are located at lower positions immediately to the rear of the transom 27*a*. Thus, the cavitation plates 28 for the outboard motors 26*a* and 26*b* are at generally the same location in a rear view as the lower end portion of the transom 27*a*. In the conventional boat, as described above, the outboard motors 26*a* and 26*b* are disposed at lower locations to ensure that the propellers 29 of the outboard motors 26*a* and 26*b* catch the water flow (a).

In contrast, in the boat (A) according to the present preferred embodiment, the outboard motors 20*a* and 20*b* are installed on the rear-surface portion 18*c* of the projecting portion 18 provided in the rear portion of the transom 17, and thus the outboard motors 20*a* and 20*b* are shifted rearward by a distance equal to the fore-and-aft length of the projecting portion 18. Thus, although the outboard motors 20*a* and 20*b* are installed at higher locations, the above-described structure ensures that the propellers 24 of the outboard motors 20*a* and 20*b* catch the water flow (a). The boat (A) is about 12 m, for example, in total length. The length (l) in the fore-and-aft direction of the projecting portion 18 shown in FIG. 6 is about 860 mm, for example. The vertical height (h) between the lower end of the transom 17 and the parallel portion 18*a* (cavitation plate 25) shown in FIG. 7 is about 100 mm, for example.

That is, if the total length of the boat (A) is equal to that of the conventional boat, the outboard motors 20*a* and 20*b* of the boat (A) are located about 860 mm behind and about 100 mm above the locations of the outboard motors 26*a* and 26*b* of the conventional boat. The height (h) is allowed to be changed depending on the length (l). When the length (l) in the fore-and-aft direction of the projecting portion 18 is further increased, the height (h) in the vertical direction between the lower end of the transom 17 and the cavitation plate 25 may be increased in proportion to the length (l). Intake openings 23*a* including a plurality of small openings are provided in upper side portions of the cowling 23 so that fresh air is taken from the outside into the cowling 23 via the intake openings 23*a*.

A side thruster 31 is disposed on a lower portion of the slanting portion 18*b* of the projecting portion 18. The side thruster 31 includes a tunnel 31*a* extending in a horizontal direction through the slanting portion 18*b* and a propeller 31*b* disposed in the center of the tunnel 31*a* such that the propeller 31*b* is driven by a drive motor (not shown) disposed in the hull 11 whereby the propeller 31*b* rotates. The rotation of the propeller 31*b* causes water to flow in the tunnel 31*a* from one end thereof to the other end thereby moving the stern portion of the boat (A) in a right and left direction. The rotation direction of the propeller 31*b* can be changed by the driving operation of the drive motor thereby to change the moving direction of the stern portion of the boat (A) to the left or the right.

Another side thruster 32 is provided in a lower portion of the front-side portion of the hull 11. The side thruster 32 includes a tunnel 32*a* extending in a horizontal direction through the bow-side portion of the hull 11 and a propeller 32*b* disposed in the center of the tunnel 32*a* such that the propeller 32*b* is driven by a drive motor (not shown) disposed in the hull 11 whereby the propeller 32*b* rotates. The rotation of the propeller 32*b* causes water to flow in the tunnel 32*a* from one end thereof to the other end thereby moving the bow portion of the boat (A) in a right and left direction. The rotation direction of the propeller 32*b* can be changed by the driving operation of the drive motor thereby to change the moving direction of the bow portion of the boat (A) to the left or the right.

Figure 10:
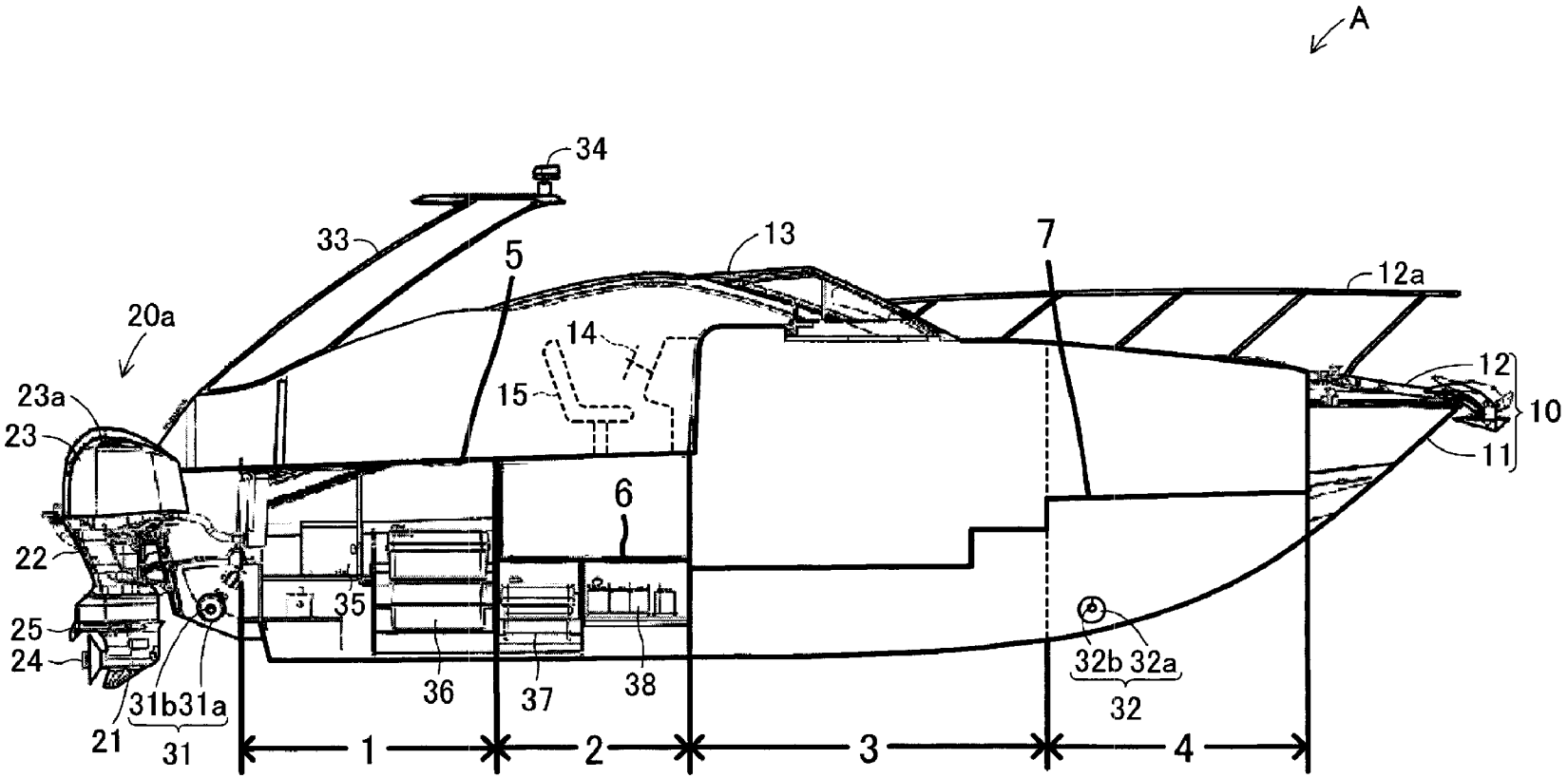
FIG. 10 is a side view illustrating sections in the boat.

A plurality of stripes 11*b* extend in the fore-and-aft direction over the bottom surface of the hull 11. These stripes 11*b* are formed by protrusions that are generally triangular in cross-section, and they are disposed so as to be spaced from each other in a direction across the width of the hull 11. A floating wing 33 in the shape of a gate extends diagonally in an upward and forward direction from the rear portion of the deck 12. A searchlight 34 is disposed on the upper surface of the floating wing 33. Furthermore, a handrail 12*a* is provided along the periphery of the deck 12 from the middle to the front end. As shown in FIG. 10, the inside of the boat body 10 is divided into sections in which an electric generator 35, a fuel tank 36, a fresh water tank 37, and a battery 38 are installed.

In FIG. 10, reference numerals 1 to 4 denote sections formed by partitioning the boat body 10 in the fore-and-aft direction, and reference numerals 5 to 7 denote boundary lines that partition the boat body 10 into upper and lower sections. That is, a lower portion of a section denoted by a reference numeral 1 in the stern-side portion of the boat body 10 is a space arranged to install the electric generators 35 and the fuel tanks 36, a lower portion of a section denoted by reference numeral 2 slightly rearward of the middle of the boat body 10 is a space arranged to install the fresh water tank 37 and the battery 38. Two electric generators 35 and two fuel tanks 36 are disposed such that one electric generator and one fuel tank are located on a left side and the other ones are located on a right side at positions corresponding to the outboard motors 20*a* and 20*b*. Lower portions of sections denoted by reference numerals 3 and 4 at the middle and at the bow of the boat body 10 are spaces arranged to install various kinds of pipes and apparatuses.

Reference numeral 5 denotes a deck floor line defining a floor of the deck 12 and also a ceiling of the sections denoted by reference numerals 1 and 2. Reference numeral 6 denotes an under berth floor line that partitions the section denoted by reference numeral 2 into upper and lower portions. The portion corresponding to the under berth floor line 6 defines a floor of an under berth provided below the deck 12 and also a ceiling of the lower portion of the section denoted by reference numeral 2. The under berth is used as a room in which a chair or the like for use by a crew is provided so that the crew can rest in this room. Reference numeral 7 denotes a main cabin/bow berth floor line. A rear-portion of this line 7 is a main cabin floor line defining a floor of a main cabin provided in an upper portion of the section denoted by reference numeral 3 and also a ceiling of the section denoted by reference numeral 3.

In the main cabin, a sofa, a shelf for placing various kinds of drinks or the like, and other articles are provided so that the crew of the boat (A) is allowed to relax in this main cabin. A front portion of the main cabin/bow berth floor line is a bow berth floor line defining a floor of a bow berth provided in an upper portion of the section denoted by reference numeral 4 and also a ceiling of a lower portion of the section denoted by reference numeral 4. The bow berth is also used as a room in which a chair or the like is disposed for use by the crew so that the crew can rest in this room. In the boat (A), as described above, spaces in the boat body 10 are used in a very efficient manner. The boat (A) runs by the driving force provided by the outboard motors 20*a* and 20*b* and it is not necessary to install the driving motor in the inside of the boat body 10. This allows an increase in the space in the boat body 10, and the increased space can be used for various purposes.

When the boat (A) constructed in the above-described manner is run, the crew including an operator and a plurality of passengers may board. After the operator sits on the operator's seat 15 in the cockpit 13, if the operator turns on the start switch disposed in the vicinity of the steering wheel 14, the boat (A) starts to run in accordance with operations of the operation lever or the steering wheel 14. As the running speed of the boat (A) is increased, the boat position is inclined such that the bow is higher than the stern. If the running speed of the boat (A) exceeds a particular speed and thus if the boat (A) is brought into the planing mode, the lower edge portion of the transom 17 cuts the water surface, and the projecting portion 18 comes to a position above the water surface. This prevents the projecting portion 18 from serving to generate resistance against the running of the boat (A).

Furthermore, as described above, the lower portions of the outboard motors 20*a* and 20*b* are brought into a water flow rising up from the lower edge of the transom 17 in a rearward direction, thereby ensuring that the propellers 24 of the outboard motors 20*a* and 20*b* catch the water flow. Thus, the boat (A) can run in a stable manner. In particular, when a turn is made at a high speed, it is possible to make the turn in a stable manner without drawing air. If the boat (A) stops on water, the projecting portion 18 is submerged. As a result, buoyancy is generated. The buoyancy prevents the stern portion, where the outboard motors 20*a* and 20*b* are installed, of the boat (A) from being submerged which would cause the boat (A) to greatly incline. When the boat (A) docks at a pier, a smooth landing is possible by operating the two side thrusters 31 and 32.

In the boat (A) according to the present preferred embodiment, as described above, the projecting portion 18 is arranged in the rear portion of the transom 17, and the outboard motors 20*a* and 20*b* are installed on the rear-surface portion 18*c* of the projecting portion 18. This structure allows the outboard motors 20*a* and 20*b* to be located at higher and further rear ward positions than in the conventional boat. This makes it possible for the boat (A) to run in a stable manner. In particular, when the boat (A) makes a turn at a high speed, the lower portions of the outboard motors 20*a* and 20*b* are stably surrounded by the water flow (a) deflected by the transom 17 (see FIG. 6), which prevents the outboard motors 20*a* and 20*b* from drawing air, and thus it is possible to make the turn in a stable manner.

Furthermore, disposing the outboard motors 20*a* and 20*b* at higher positions causes less of each of the outboard motors 20*a* and 20*b* to be submerged, which results in an increase in propulsion efficiency. Furthermore, the electronic unit or the like placed in the cowling 23 of each of the outboard motors 20*a* and 20*b* is located sufficiently far from the water surface, and thus it becomes possible to ensure that the electronic unit is protected from water. Furthermore, because the side thruster 31 is provided in the projecting portion 18 and the side thruster 32 is provided in the bow-side portion of the boat body 10, it becomes possible to adjust the position at both the bow and the stern, and thus the operation in bringing the boat alongside a pier or the like becomes easier.

Furthermore, because the central portion of the projecting portion 18 includes a slanting portion 18*b* extending rearward and upward from the lower portion of the transom, it becomes possible to prevent the projecting portion 18 from being brought into contact with water and producing resistance when the boat (A) runs. Furthermore, because the boat (A) is constructed into the double ender shape by providing the projecting portion 18 on the stern, an improvement is achieved in running performance when the boat (A) runs backward. Furthermore, in the boat (A), although the cavitation plates 25 of the outboard motors 20*a* and 20*b* are disposed at high locations, the cavitation plates 25 are capable of applying resistance to the water in a highly reliable manner thereby preventing the propellers 24 from drawing air. Furthermore, in the boat (A), the use of two outboard motors 20*a* and 20*b* makes it possible to output the driving force necessary to drive the boat (A) with a rather large size.

It is understood that the boat according to the present invention is not limited to the preferred embodiments described above, but modifications are possible. For example, in a preferred embodiment described above, the step is preferably provided between the transom 17 and the projecting portion 18. Alternatively, the projecting portion may be constructed to have a surface that is gradually inclined from the peripheral portion of the transom. Furthermore, the number of outboard motors is not limited to two. Only one outboard motor may be used, or, conversely, a number of outboard motors greater than two may be used depending on the size of the boat. Furthermore, the shape of the boat is not limited to that according to the preferred embodiments described above. The boat may be constructed into any shape as long as the boat is capable of running by an outboard motor installed on the boat.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A boat body comprising:

a hull including a transom extending substantially vertically upward from a bottom rear portion of the hull, the hull also including a projecting portion extending rearward from a rear portion of the transom; and an installation member connected to the projecting portion of the transom, the installation member arranged to support an outboard motor; wherein the projecting portion extends rearward from the rear portion of the transom such that an outboard motor installed on the installation member is located further upward and rearward than in a case where the outboard motor is directly installed on the transom;

the projecting portion includes a short portion extending rearward from the transom, a slanting portion extending rearward and upward from the short portion, and a rear surface portion extending upward from the slanting portion; and the slanting portion has a V-shape when viewed in a rear view.

2. The boat body according to claim 1, wherein the projecting portion includes a side thruster passing through the projecting portion in a horizontal direction.

3. A boat comprising:

an outboard motor mounted on the installation member of the boat body according to claim 1; wherein when the boat is at rest on water, the projecting portion is submerged in water thereby generating buoyancy at a rear portion of the boat; and when the boat is running faster than a specified speed, the projecting portion rises above the water surface.

4. The boat according to claim 3, wherein the projecting portion includes a lower edge portion located higher than a lower edge portion of the transom; and a cavitation plate is disposed above and adjacent to a propeller connected to the outboard motor, and the outboard motor is installed on the installation member such that the cavitation plate is at generally the same height as the lower edge portion of the projecting portion as viewed from the rear of the boat.

5. The boat according to claim 3, wherein a plurality of outboard motors are installed on the installation member such that the outboard motors are located side by side in a horizontal direction of the boat.

6. A boat body comprising:

a hull including a transom extending substantially vertically upward from a bottom rear portion of the hull, the hull also including a projecting portion extending rearward from a rear portion of the transom; and an installation member connected to the projecting portion of the transom, the installation member arranged to support an outboard motor; wherein the projecting portion extends rearward from the rear portion of the transom such that an outboard motor installed on the installation member is located further upward and rearward than in a case where the outboard motor is directly installed on the transom;

the hull includes a recess provided in a central portion of the rear portion of the hull and left and right step portions extending rearward from left and right sides of the recess, respectively; and the installation member is disposed within the recess.

7. The boat body according to claim 6, wherein the projecting portion includes a short portion extending rearward from the transom, a slanting portion extending rearward and upward from the short portion, and a rear surface portion extending upward from the slanting portion; and the slanting portion has a V-shape when viewed in a rear view.

8. The boat body according to claim 6, wherein the projecting portion includes a side thruster passing through the projecting portion in a horizontal direction.

9. A boat comprising:

an outboard motor mounted on the installation member of the boat body according to claim 6, wherein when the boat is at rest on water, the projecting portion is submerged in water thereby generating buoyancy at a rear portion of the boat; and when the boat is running faster than a specified speed, the projecting portion rises above the water surface.

10. The boat according to claim 9, wherein the projecting portion includes a lower edge portion located higher than a lower edge portion of the transom; and a cavitation plate is disposed above and adjacent to a propeller connected to the outboard motor, and the outboard motor is installed on the installation member such that the cavitation plate is at generally the same height as the lower edge portion of the projecting portion as viewed from the rear of the boat.

11. The boat according to claim 9, wherein a plurality of outboard motors are installed on the installation member such that the outboard motors are located side by side in a horizontal direction of the boat.

12. A boat body comprising:

a hull including a transom extending substantially vertically upward from a bottom rear portion of the hull, the hull also including a projecting portion extending rearward from a rear portion of the transom; and an installation member connected to the projecting portion of the transom, the installation member arranged to support an outboard motor; wherein the projecting portion extends rearward from the rear portion of the transom such that an outboard motor installed on the installation member is located further upward and rearward than in a case where the outboard motor is directly installed on the transom;

the projecting portion includes a short portion extending rearward from the transom, a slanting portion extending rearward and upward from the short portion, and a rear surface portion extending upward from the slanting portion; and a lowermost end of the rear surface portion of the projecting portion is disposed at substantially the same vertical position as a cavitation plate of the outboard motor installed on the installation member.

13. The boat body according to claim 12, wherein the slanting portion has a V-shape when viewed in a rear view.

14. The boat body according to claim 12, wherein the projecting portion includes a side thruster passing through the projecting portion in a horizontal direction.

15. A boat comprising:

an outboard motor mounted on the installation member of the boat body according to claim 12; wherein when the boat is at rest on water, the projecting portion is submerged in water thereby generating buoyancy at a rear portion of the boat; and when the boat is running faster than a specified speed, the projecting portion rises above the water surface.

16. The boat according to claim 15, wherein the lowermost end of the rear surface portion of the projecting portion is located higher than a lower edge portion of the transom.

17. The boat according to claim 15, wherein a plurality of outboard motors are installed on the installation member such that the outboard motors are located side by side in a horizontal direction of the boat.

* * * * *